United States Patent [19]

Ringgenberg

[11] Patent Number: 4,817,723

[45] Date of Patent: Apr. 4, 1989

[54] APPARATUS FOR RETAINING AXIAL MANDREL MOVEMENT RELATIVE TO A CYLINDRICAL HOUSING

[75] Inventor: Paul D. Ringgenberg, Duncan, Okla.

[73] Assignee: Halliburton Company, Duncan, Okla.

[21] Appl. No.: 78,484

[22] Filed: Jul. 27, 1987

[51] Int. Cl.[4] ..... E21B 34/08

[52] U.S. Cl. ..... 166/321; 166/323; 166/386

[58] Field of Search ..... 166/320, 321, 323, 331, 166/240, 250, 336, 374, 386

[56] References Cited

U.S. PATENT DOCUMENTS

| | | |
|---|---|---|
| 3,051,240 | 8/1962 | Fisher, Jr. . |
| 3,823,773 | 7/1974 | Nutter . |
| 3,850,250 | 11/1974 | Holden et al. . |
| 3,891,033 | 6/1975 | Scott . |
| 3,897,825 | 8/1975 | Tausch . |
| 3,930,540 | 1/1976 | Holden et al. . |
| 3,970,147 | 7/1976 | Jessup et al. . |
| 3,986,554 | 10/1976 | Nutter . |
| 4,063,593 | 12/1977 | Jessup . |
| 4,064,937 | 12/1977 | Barrington . |
| 4,105,075 | 8/1978 | Helmus . |
| 4,113,012 | 9/1978 | Evans et al. . |
| 4,258,793 | 3/1981 | McGraw et al. . |
| 4,324,293 | 4/1982 | Hushbeck . |
| 4,328,866 | 5/1982 | Zimmerman . |
| 4,355,685 | 10/1982 | Beck . |
| 4,403,659 | 9/1983 | Upchurch . |
| 4,452,313 | 6/1984 | McMahan . |
| 4,474,242 | 10/1984 | Upchurch . |
| 4,498,536 | 2/1985 | Ross et al. . |
| 4,632,187 | 12/1989 | Deaton ..... 166/323 |
| 4,633,952 | 1/1987 | Ringgenberg . |
| 4,650,001 | 3/1987 | Ringgenberg . |
| 4,657,082 | 4/1987 | Ringgenberg . |
| 4,691,779 | 9/1987 | McMahan et al. ..... 166/323 X |

*Primary Examiner*—William P. Neuder

*Attorney, Agent, or Firm*—James R. Duzan; Alan T. McCollum

[57] ABSTRACT

Apparatus for retaining axial mandrel movement relative to a cylindrical housing. A cylindrical housing has an open longitudinal passageway therethrough and a circulation port disposed through a wall thereof. A valve mandrel is slidably received in the housing and is moveable between a position in which fluid may be circulated only between the passageway and the exterior of the housing, a position in which fluid may be circulated only between the exterior of the housing and the passageway and a position in which fluid may not be circulated in either direction. An annular piston is operatively connected to the valve mandrel and has a first side exposed to the pressure exterior of the housing and a second side exposure to the pressure interior of the housing to permit movement of the valve mandrel to its various positions by application of pressure to the interior and exterior of the housing. A substantially cylindrical spring includes a plurality of elongate fingers disposed about the circumference of a splined mandrel to which the valve mandrel is connected. The spring includes a substantially arcuate collar formed about the radially inner surface thereof which is engagable with different grooves in the splined mandrel in order to retain the valve mandrel in preselected positions. A pressure differential of a predetermined value between the annulus and the passageway is required to bow the spring fingers radially outwardly thereby enabling mandrel movement while preventing mandrel movement in response to low pressure pump surges and low pressure differentials generated by movement of the pipe string on which the tool is suspended.

20 Claims, 8 Drawing Sheets

APPARATUS FOR RETAINING AXIAL MANDREL MOVEMENT RELATIVE TO A CYLINDRICAL HOUSING

The present invention relates generally to downhole tools of the type that include a mandrel which is axially slidable responsive to annulus or drill string pressure and more particularly, but not by way of limitation, to such tools in which the mandrel is retained at a predetermined position.

The prior art includes a number of downhole tools in which a mandrel is received for axial sliding in a cylindrical housing. Some such tools may be operated by pressurizing the pipe string from which the tools is suspended and/or by pressurizing the annulus between the tool and the well bore. Such pressurization causes axial shifting of the mandrel thereby operating the tool.

One such prior art tool as above-described is disclosed in U.S. Pat. No. 4,657,082 for a circulation valve and method for operating the same having the same inventor and assignee of the instant application. As described in the patent, the circulation valve includes a mandrel which is axially shifted in a cylindrical housing in one direction by pressurizing the pipe string to a pressure greater than that in the annulus and in the other direction by pressurizing the annulus to a pressure greater than that in the pipe string. This prior art circulation valve includes a series of j-slots which guide the mandrel during axial shifting in order to open or close a circulation valve only after so alternating pressure in the pipe string and annulus a predetermined number of times.

Such prior art pressure operated tools may be inadvertently operated. For example, in the case of the prior art circulation valve above described, the same is normally incorporated into a test string which includes a packer beneath the circulation valve. After drill stem testing is complete, it is normally desirable to open the circulation valve prior to pulling the pipe string so that fluids in the pipe string will drain into the bore through the circulation valve rather than spilling onto the rig floor as sections of pipe are disconnected. As the pipe string is pulled, pressure in the annulus momentarily increases due to the swabbing action of the packer which is very closely received in the well bore even when the same is disengaged from the well bore wall. Such pressure increases may be as great as 50 p.s.i. which can cause axial mandrel shifting. Thus, when pulling a pipe string from the well bore which includes the described prior art circulation valve and a packer therebeneath, the circulation valve may cycle to a closed position. If such occurs the next section of pipe which is disconnected at the drilling rig platform is full of fluid.

Another problem which has been experienced when using pressure operated tools in a pipe string relates to pressure surges in the pump which is used to pressurize fluid in the pipe string or in the annulus. For example, during drill stem testing, the fluid in the pipe string is typically of a much lighter weight than the heavy fluids in the annulus. When it is necessary to pressurize the pipe string in order to cycle the pressure-operated circulation valve, or to operate another pressure-operated tool which may be in the pipe string, it may be necessary to apply pressures as high as 2000 p.s.i. or higher at the surface in order to equalize the pressure in the pipe string and the annulus at the level of the tool. Pumps which are used for this purpose often have surges sufficient to cycle the tool when operating at such pressures. Thus, the pressure-operated tool may be inadvertently cycled by such surges when attempting to operate the tool or when attempting to operate a different pressure-operated tool in the pipe string.

There exist prior art devices such as shear pins and constant drag mechanisms for retaining mandrels in a cylindrical housing. Of course with respect to shear pins, after the pin is sheared responsive to a pressure build up or responsive to application of mechanical force, the mandrel may no longer be retained until the tool is again pulled to the surface and the shear pin replaced.

A constant drag mechanism, such as drag blocks, prevent mandrel movement until the pressure is increased above a predetermined value; however, the pressure must be maintained above that value in order to continue mandrel movement. In the case of the prior art circulation valve above-described, such a mechanism would not permit the circulation valve to fully open because once the circulation port is partially opened, the pressure differential causes flow therethrough rather than mandrel movement. The momentum of the moving mandrel is thus necessary to move the valve to its fully opened condition. A constant drag mechanism, such as drag blocks, would not permit the mandrel to assume its fully opened condition.

The present invention provides an apparatus for retaining axial mandrel movement relative to a cylindrical housing in a pressure-operated downhole tool until the pressure is increased above a predetermined value. After mandrel movement begins responsive to such an increase, mandrel movement is maintained by application of a relatively low pressure.

The downhole tool of the present invention comprises a cylindrical housing having an open longitudinal passageway therethrough. A mandrel is slidably received in the housing and is axially moveable between a first position and a second position. Means for moving the mandrel between its first and second positions is provided. The moving means is responsive to a pressure differential between the interior of the pipe string and the annulus of the well bore. Means for retaining the mandrel in one of the positions until a pressure differential exceeds a predetermined value is also provided. The retaining means is constructed and arranged to so retain the mandrel each time the mandrel moves to said one position.

Numerous objects, features and advantages of the present invention will be readily apparent to those skilled in the art upon reading of the following disclosure when taken in conjunction with the accompanying drawings, wherein.

Figure 2A:
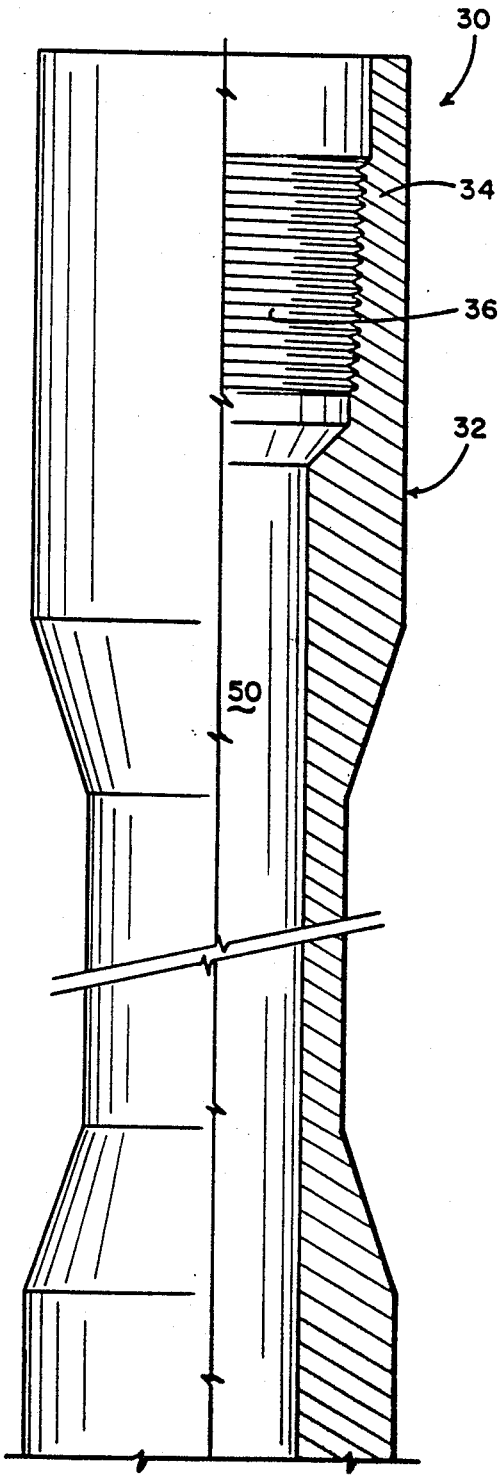
FIGS. 2A–2F are elevational quarter-section views showing a downhole tool incorporating the instant embodiment of the invention.
Figure 2B:
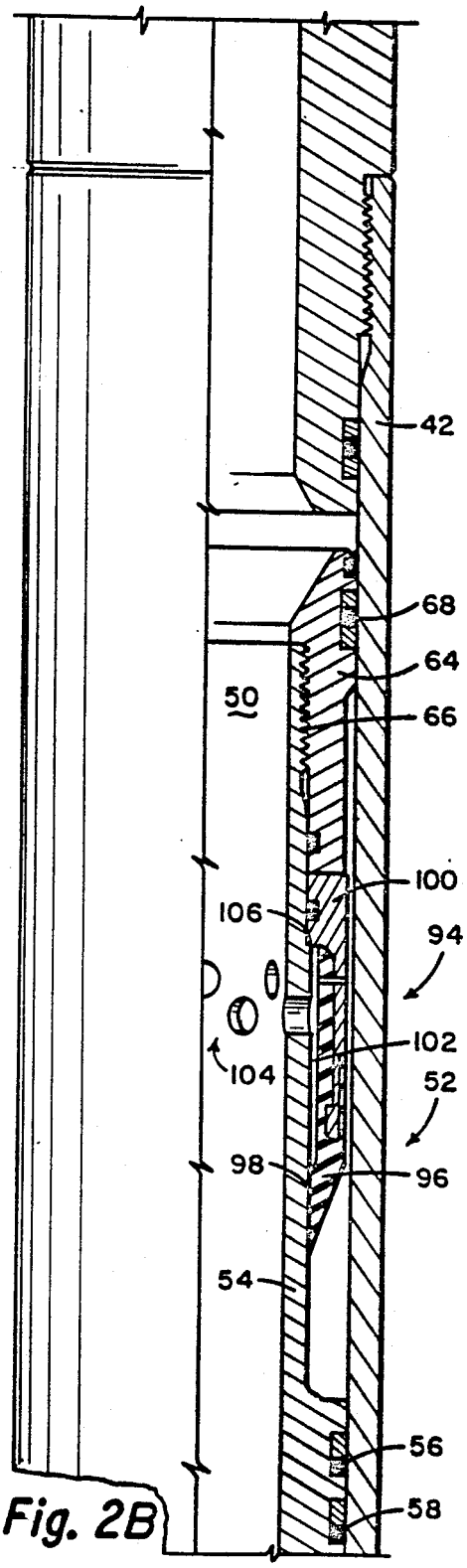
Figure 2C:
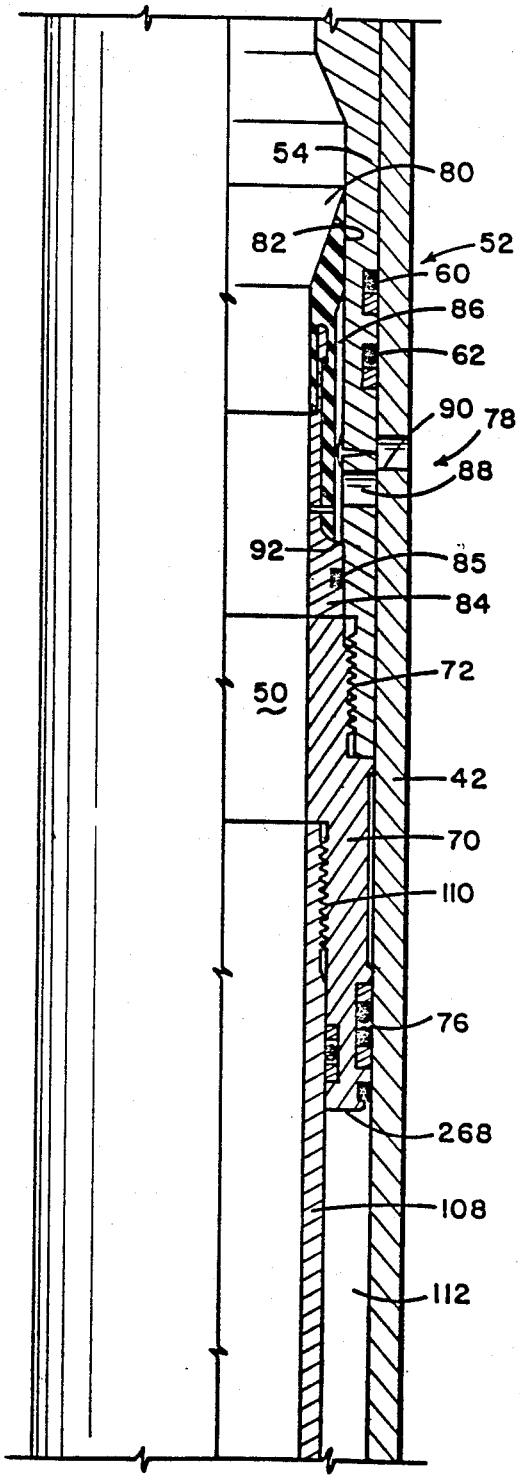
Figure 2D:
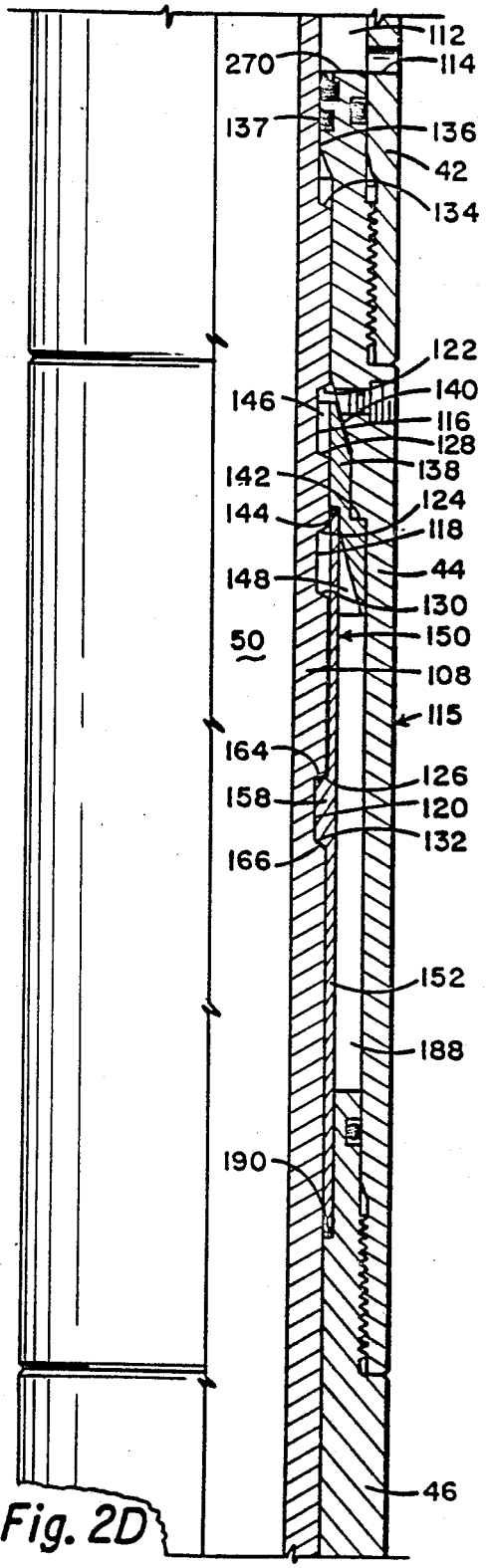
Figure 2E:
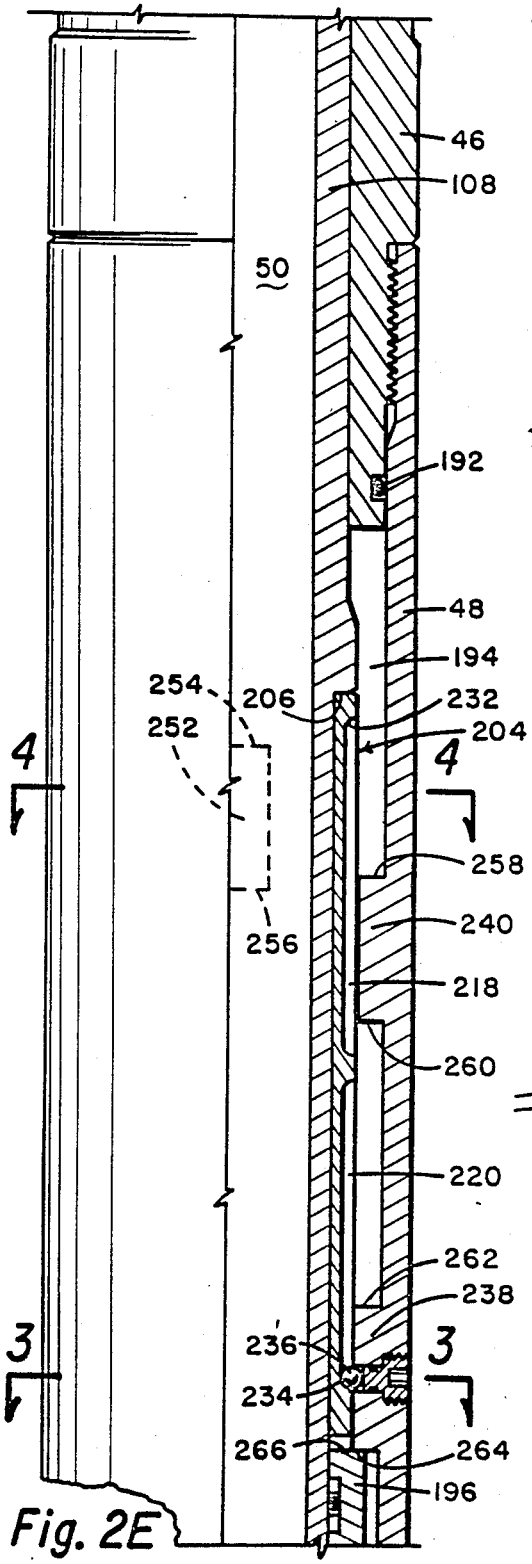
Figure 4:
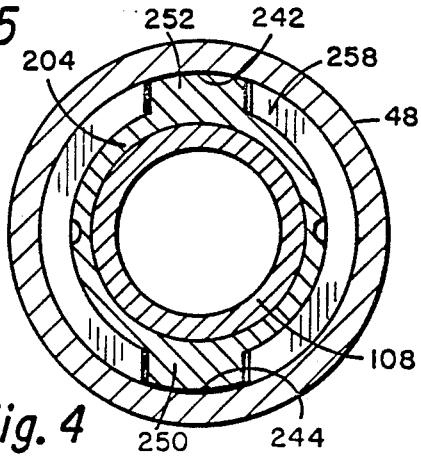

FIG. 4 a view taken along line 4—4 in FIG. 2E.

Figure 5:
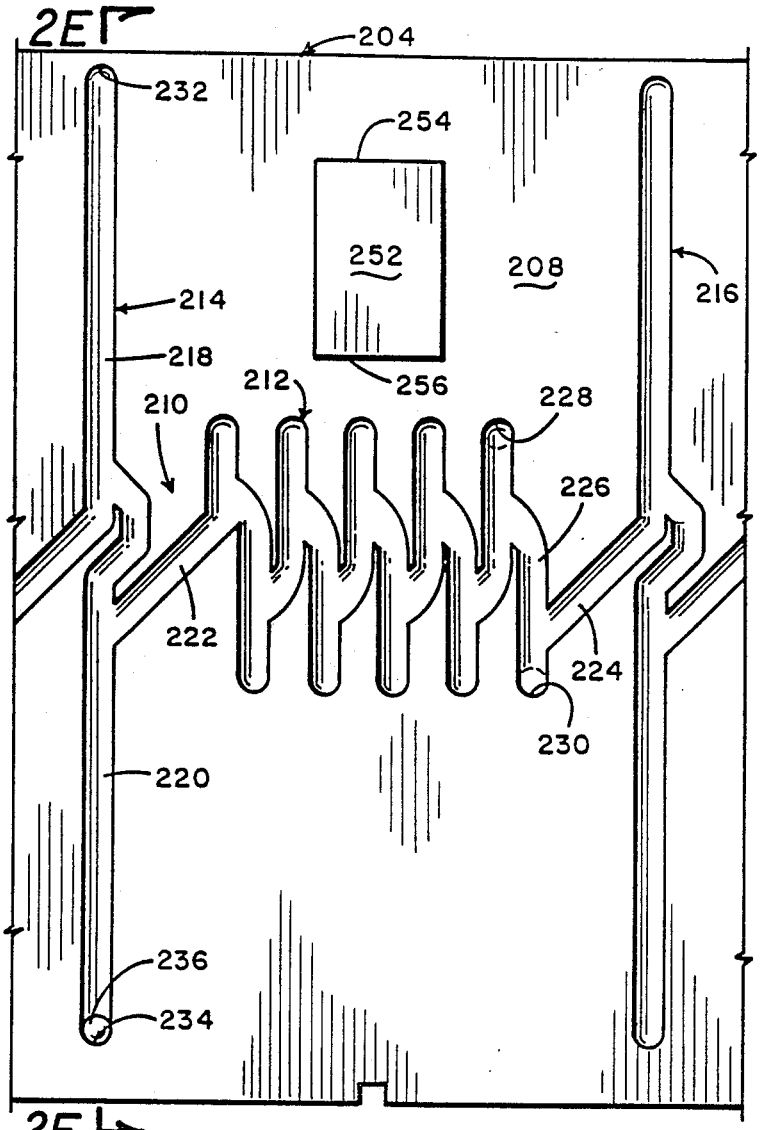
Figure 3:
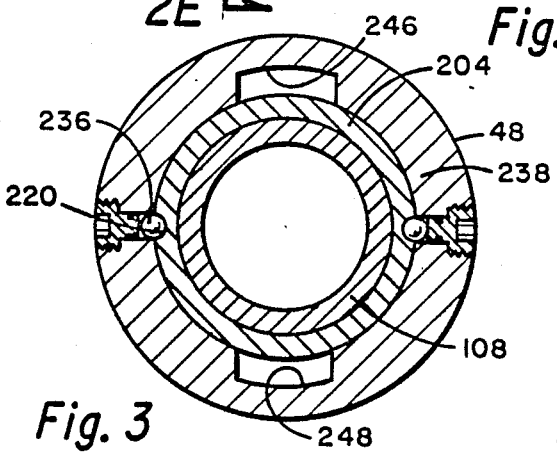
FIG. 3 is a view taken along line 3—3 in FIG. 2E.

FIG. 5 is a laid-out view of a portion of the indexing sleeve of FIG. 2E showing the appearance of the sleeve as if it had been cut along its length at one side and then rolled out flat into a rectangular shape. The line 2E—2E indicates the location of the section through the sleeve which is seen in FIG. 2E FIG. 6 is a elevational quarter-section view of that portion of the tool shown in FIG. 2D with the section of FIG. 6 being shifted 26° clockwise (as viewed from the top of the tool) from the section of FIG. 2D.

Figure 6:
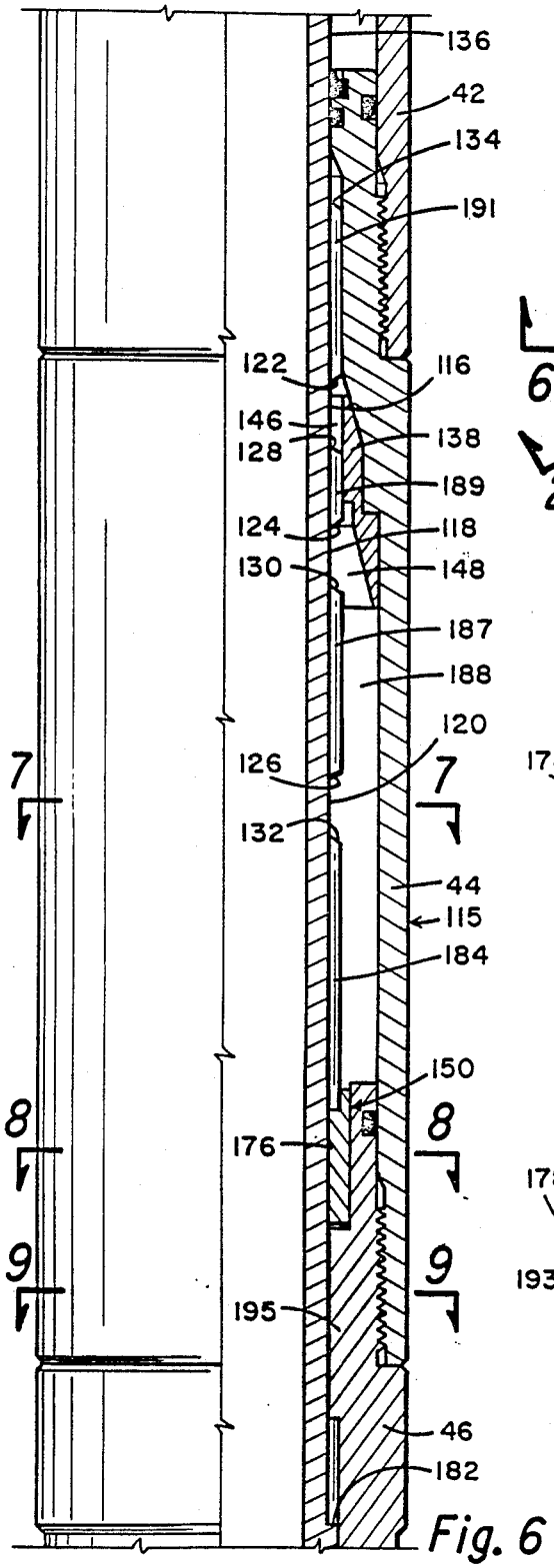
Figure 7:
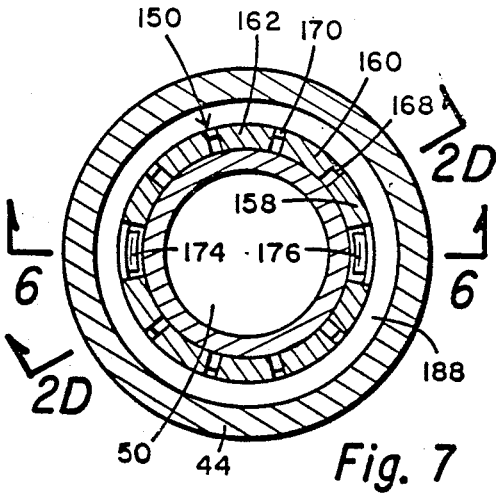

FIG. 7 is a view taken along line 7—7 in FIG. 6 and showing the relative positions of the sections shown in FIGS. 2D and 6.

Figure 8:
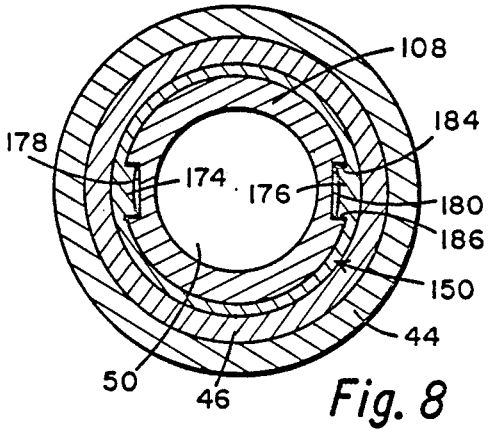

FIG. 8 is a view taken along line 8—8 in FIG. 6.

Figure 9:
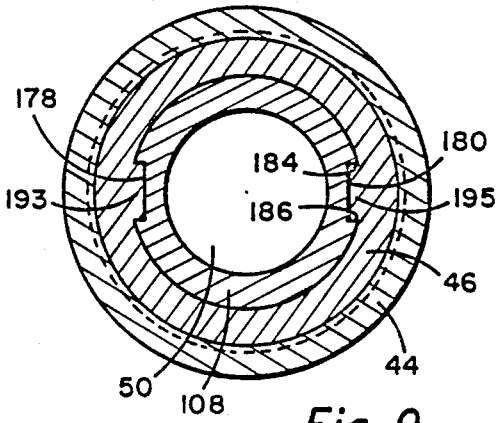

FIG. 9 is a view taken along line 9—9 in FIG. 6.

Figure 10:
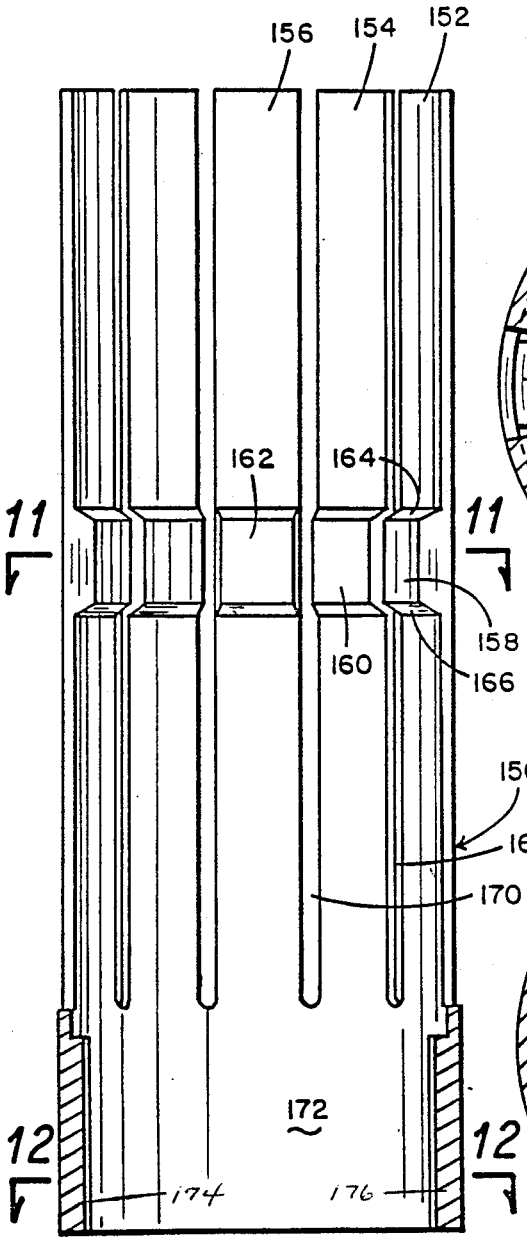

FIG. 10 is a cross-sectional view of the spring member shown in FIGS. 2D and 6.

Figure 11:
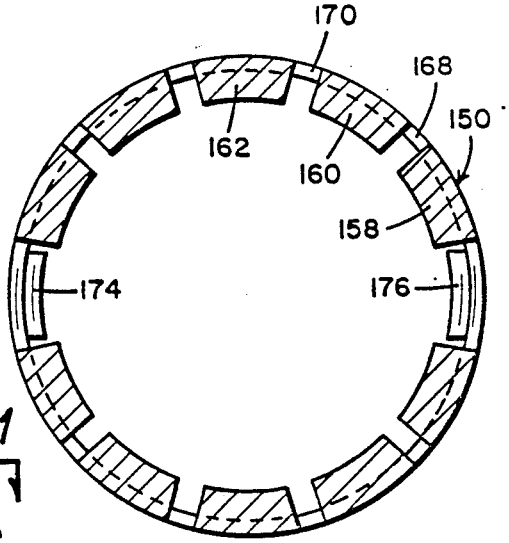

FIG. 11 is a view taken along line 11—11 in FIG. 10.

Figure 12:
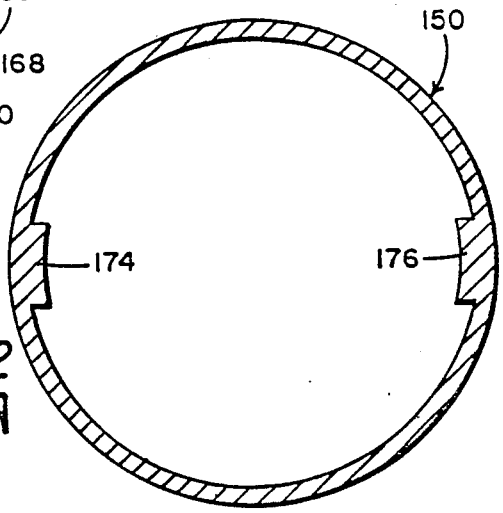

FIG. 12 is a view taken along line 12—12 in FIG. 10.

DETAILED DESCRIPTION OF THE PREFERRED EMBODIMENT OF THE INVENTION

During the course of drilling an oil well, the borehole is filled with a fluid known as drilling fluid or drilling mud. One of the purposes of this drilling fluid is to contain in intersectioned formations any fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus. Alternately, the string may be stabbed into a previously set production packer.

The valve at the lower end of the testing string is then opened and the formation fluid, free from the restraining pressure of the drilling fluid, can flow into the interior of the testing string.

The testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the testing program, a circulation valve in the test string is opened, formation fluid in the testing string is circulated out, the packer is released, and the testing string is withdrawn.

Over the years various methods have been developed to open the tester valves located at the formation depth as described. These methods include string rotation, string reciprocation, and annulus pressure changes. Particularly advantageous tester valves are those shown in U.S. Pat. Nos. 3,856,085 to Holden, et al., 4,422,506 and 4,429,748 to Beck, and 4,444,268 and 4,448,254 to Barrington. These valves operate responsive to pressure changes in the annulus and provide a full opening flow passage through the tester valve apparatus.

The annulus pressure operated method of opening and closing the tester valve is particularly advantageous in offshore locations where it is desirable to the maximum extent possible, for safety and environmental protection reasons, to keep the blowout preventors closed during the major portion of the testing procedure.

Figure 1:
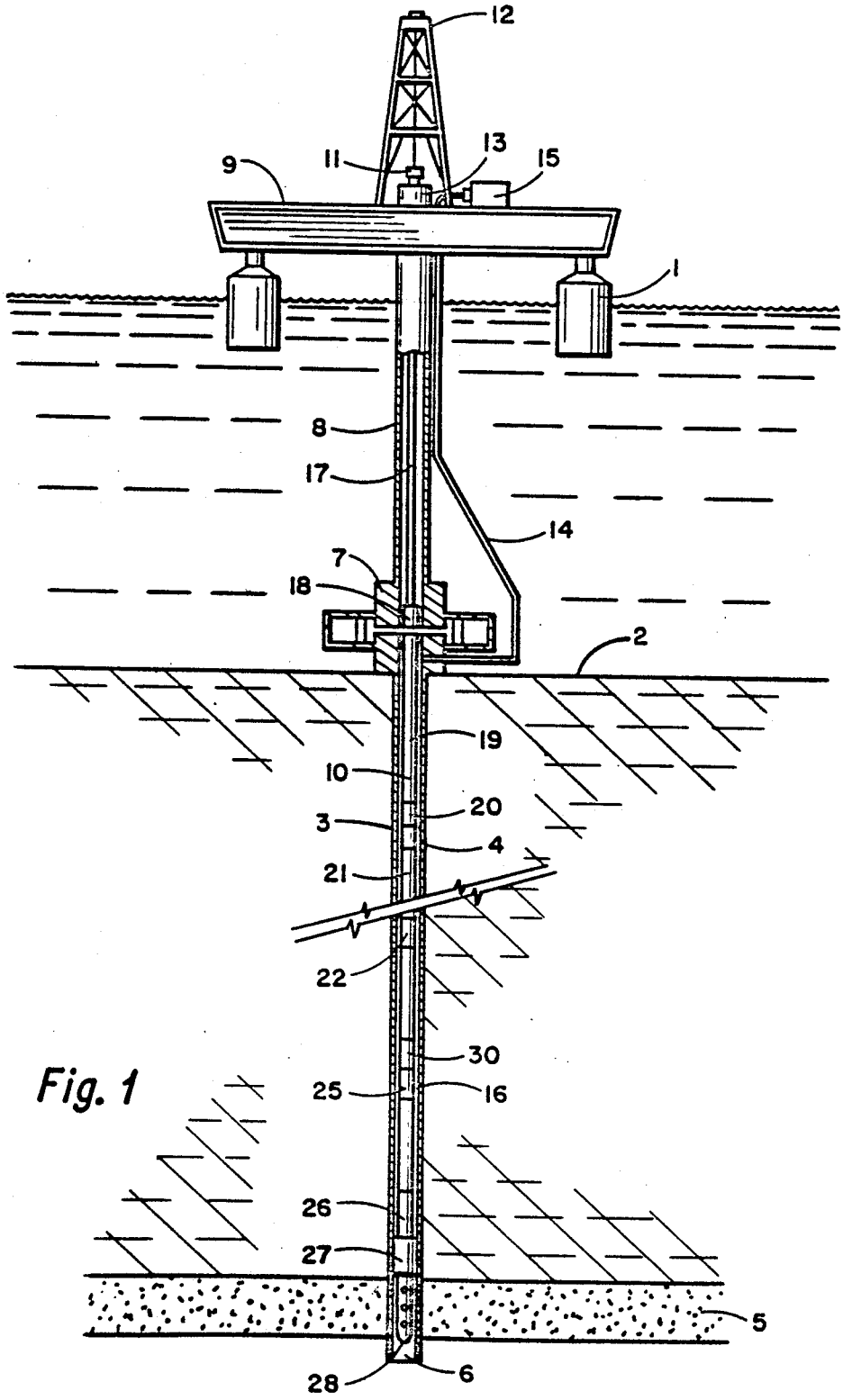
FIG. 1 is a schematic elevation view of a typical well testing apparatus using the instant embodiment of the invention.

A typical arrangement for conducting a drill stem test offshore is shown in FIG. 1. Such an arrangement would include a floating work station 1 stationed over a submerged work site 2. The well comprises a well bore 3 typically lined with a casing string 4 extending from the work site 2 to a submerged formation 5. The casing string 4 includes a plurality of perforations at its lower end which provide communication between the formation 5 and the interior of the well bore 6.

At the submerged well site is located a well head installation 7 which includes blowout preventor mechanisms. A marine conductor 8 extends from the well head installation to the floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into the well bore 3 a formation testing string 10 which is raised and lowered in the well by hoisting means 11.

A supply conduit 14 is provided which extends from a hydraulic pump 15 on the deck 9 of the floating station 1 to the well head installation 7 at a point below the blowout preventors to allow the pressurizing of the well annulus 16 surrounding the test string 10.

The testing string includes an upper circuit string portion 17 extending from the work station 1 to the well head installation 7. A hydraulically operated conduit string test tree 18 is located at the end of the upper conduit string 17 and is landed in the well head installation 7 to thus support the lower portion of the formation testing string. The lower portion of the formation testing string extends from the test tree 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balanced slip joint means 20. An intermediate conduit portion 21 is provided for imparting packer setting weight to the packer mechanism 27 at the lower end of the string.

It is many times desirable to place near the lower end of the testing string a conventional circulating valve 22 which may be opened by rotating or reciprocation of the testing string or a combination of both or by the dropping of a weighted bar in the interior of the testing string 10. This circulation valve is provided as a back-up means to provide for fluid communication in the event that the circulation valve of the present apparatus should fail to open properly. Also near the lower end of the formation testing string 10 is located a tester valve 25 which is preferably a tester valve of the annulus pressure operated type such as those disclosed in U.S. Pat. Nos. 3,856,085; 4,422,506; 4,429,748; 4,444,268; and 4,448,254. Immediately above the tester valve is located a tool 30 which incorporates the apparatus of the present invention.

A pressure recording device 26 is located below the tester valve 25. The pressure recording device 26 is preferably one of which provides a full opening passageway through the center of the pressure recorder to provide a full opening passageway through the entire length of the formation testing string.

It may be desirable o add additional formation testing apparatus in the testing string 10. For instance, where it is feared that the testing string 10 may become stuck in the borehole 3 it is desirable to add a jar mechanism between the pressure recorder 26 and the packer assembly 27. The jar mechanism is used to impart blows to the testing string to assist in jarring a testing string loose from the bore-hole in the event that the testing string should become stuck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recording device may be varied as desired. For instance, the pressure recorder may be located below the perforated tail piece 28 in a suitable pressure recorder anchor shoe running case. In addition, a second pressure recorder may be run immediately above the tester valve 25 to provide further data to assist in evaluating the well.

In FIGS. 2A–2F, an enlarged sectional view of tool 30 is illustrated. Tool 30 includes a cylindrical outer housing, generally designated by the numeral 32, having an upper housing adapter 34 which includes threads 36 for attaching tool 30 to the portion of testing string 10 located above the tool.

At the lower end of housing 32 is a lower housing adapter 38 (in FIG. 2F) which includes an externally threaded portion 40 for connection of tool 30 to a portion of test string 10 located below the tool.

Housing 32 further includes an upper housing section 42, a retaining mechanism housing section 44, intermediate housing section 46 and a lower housing section 48. The interior of the components making up housing 32 forms a fluid flow passageway 50 axially through tool 30. The various housing sections and the upper and lower adapters are threadably connected to one another via threaded connections as shown in the drawing with each such threaded connection being sealed with O-rings as shown.

Indicated generally at 52 in FIGS. 2B and C is a circulation valve. A generally tubular valve mandrel 54 is closely received within upper housing section 42 and is sealingly engaged therewith via O-rings 56, 58, 60, 62. An upper valve sleeve 64 is closely received within upper housing section 42 and is threadably engaged via threads 66 to the upper end of valve mandrel 54. An O-ring 68 sealingly engages the radially outer surface of upper valve sleeve 64 to the radially inner surface of upper housing section 42. A lower valve sleeve 70, in FIG. 2C, is threadably engaged via threads 72 to the lower end of valve mandrel 54. O-ring pair 76 seals between the radially outer surface of lower valve sleeve 70 and the radially inner surface of upper housing section 42.

Valve mandrel 54 includes a lower check valve indicated generally at 78. Included therein is a resilient valve portion 80, such comprising an annular lip having a radially outer surface 82 which bears against the radially inner surface of valve mandrel 54. Valve portion 80 is inserted over and carried by a valve portion carrier 84. A seal 85 seals between the radially outer surface of the valve portion carrier and the radially inner surface of valve mandrel 54. Carrier 84 supports valve portion 80 to create an annular space 86 between the radially outer surface of the valve portion and the radially inner surface of valve mandrel 54. A plurality of bores, one of which is bore 88, is formed through valve mandrel 54 about the circumference thereof. Upper housing section 42 includes a plurality of circulating ports disposed about the circumference thereof, one of which is circulating port 90, to permit fluid communication between the interior and exterior of upper housing section 42.

Valve portion carrier 84 is received between the upper end of lower valve sleeve 70 and a beveled shoulder 92 and is thus restrained from axial movement relative to valve mandrel 54.

In FIG. 2B, an upper check valve is indicated generally at 94. Included therein is a resilient valve portion 96 having an annular lip which has a radially inner surface 98 that is sealingly engaged against the radially outer surface of valve mandrel 54 about its circumference. Resilient valve portion 96 is carried by a valve portion carrier 100. between the radially inner surface of resilient valve portion 96 and the radially outer surface of the valve mandrel.

A plurality of bores indicated generally at 104 provide fluid communication between the interior of valve mandrel 54 and space 102 about the circumference of the valve mandrel. Valve portion carrier 100 is received between the lower end of upper valve sleeve 64 and a beveled shoulder 106 formed on the radially outer surface of valve mandrel 54 about its circumference and is thus restrained from axial movement relative to the valve mandrel.

A splined mandrel 108 in FIGS. 2C, 2D, 2E and 2F has an upper end threadably secured via threads 110 to the lower end of lower valve sleeve 70. The radially outer surface of splined mandrel 108 and the radially inner surface of upper housing section 42 define therebetween an upper annular space 112 which is in communication with the exterior of the tool via a power port 114.

Referring now to FIG. 2D, indicated generally at 115 is mandrel retaining means.

The radially outer surface of mandrel 108 includes circumferential grooves 116, 118, 120. Grooves 116, 118, 120 each include a circumferential upper cam shoulder 122, 124, 126, respectively, and a circumferential lower cam shoulder 128, 130, 32, respectively.

A cam shoulder 134 is formed about the circumference of mandrel 108 adjacent a recessed portion 136 thereof. An O-ring 37 seal is received in the upper portion of retaining mechanism housing section 44 on the radially inner surface thereof to seal against mandrel 108.

A spring retainer 138 or annular ring is received between mandrel 108 and retaining mechanism housing section 44. The spring retainer includes an upper beveled portion 140 which is substantially flushly abutted against a beveled portion formed on the radially inner surface of housing section 44. An upward facing annular shoulder 142 abuts against a corresponding downward facing annular shoulder formed on the radially inner surface of housing section 44 thereby preventing upward movement of spring retainer 138 relative to housing section 44. A downward facing annular shoulder 144 is formed on the radially inner surface of spring retainer 138. In the configuration of the tool shown in FIG. 2D, spring retainer 138 defines an upper annular space 146 between the radially inner surface of the spring retainer and mandrel 108. A lower annular space 148 is defined for all positions of the tool and is formed between the radially inner surface of spring retainer 138 and the radially outer surface of a spring 150, such being also referred to herein as an annular spring member.

Portions of spring 150 are also shown in the views of FIGS. 6–8 and spring 150 is shown standing alone in FIGS. 10–12. Spring 150 includes a plurality of elongate fingers, such as fingers 152, 154, 156, etc. distributed around the circumference thereof. Each of the fingers includes an arcuate segment or ridge, like segments 158, 160, 162 on fingers 152, 154, 156, respectively. Taken together each of the segments define what is referred to herein as a substantially annular collar. Each segment includes an upper cam shoulder, like upper cam shoulder 164 on segment 158 and a lower cam shoulder, like lower cam shoulder 166 on segment 158. Each of the elongate fingers, like fingers 152, 154, 156 are formed by cutting slots, like slots 168, 170 in a piece of steel tubing 172. The fingers may thus be biased inwardly and outwardly relative to the longitudinal axis of tubing 172. When biasing forces are not applied to the fingers, the spring assumes the position shown in the drawings. A pair of opposing lugs 174, 176 are formed at the lower end of the spring. Lug 176 is also viewable in FIG. 6 with both lugs being shown in FIGS. 7 and 8.

As previously described, mandrel 108 includes an upper recessed portion 136 having a smaller outside diameter than that portion of the mandrel appearing directly therebeneath. The portion appearing directly beneath recessed portion 136 includes therein a pair of opposing longitudinal slots 178, 180 (in FIGS. 8 and 9) which transverse circumferential grooves 116, 118, 120. Opposing lugs 174, 176 on spring 150 are received within slots 178, 180, respectively. Slot 180 includes a lower end 182 and an upper end at cam shoulder 134. Slot 180 further includes a pair of opposing sides 184, 186 between lower end 182 of the slot and groove 120. Side 184 is visible in FIG. 6 with the similarly situated sides 187, 189, 191 of slot 180 between groove 120 and groove 118, between groove 118 and groove 116, and between groove 116 and shoulder 134, respectively, also being visible in FIG. 6.

Lugs 174, 176 on spring 150 are received in slots 178, 180 respectively. Also received in slots 178, 180 are a pair of opposing axial lugs 193, 195 formed on the radially inner surface of intermediate housing section 46.

An annular space 188 is defined between the radially outer surface of spring 150 and the radially inner surface of retaining mechanism housing section 44.

The lower end of spring 150 is abutted against an upward facing shoulder 190 (viewable in FIG. 2D) formed on the radially inner surface of intermediate housing section 46. Spring 150 is thus restrained against longitudinal movement relative to cylindrical outer housing 32, which is defined by housing sections 42, 44, 46 in the views of FIGS. 2D and 6.

Directing attention now to FIG. 2E, an O-ring 192 defines the upper end of a lower annular space 194 which has as its outer boundary the radially inner surface of lower housing section 48. The radially inner boundary of space 194 is defined by the outer surface of mandrel 108 and the outer surface of a lower mandrel 196 which is threadably secured to the lower end of splined mandrel 108 via threads 198.

Disposed at the lower end of annular space 194 is an annular floating piston 200. Piston 200 is sealingly and slidingly received between the radially outer surface of lower mandrel 196 and the radially inner surface of lower housing section 48. Lower annular space 194 is filled with oil to provide lubrication to moving parts, to be hereinafter more fully described, contained within space 194. The lower side of floating piston 200 is in fluid communication with the exterior of tool 30 via a port 202 formed through the wall of lower housing section 48. The floating piston prevents drilling mud and other contaminates in the well bore from becoming mixed with the oil contained in annular space 194 above the floating piston.

In FIG. 2E, an indexing sleeve 204 is closely received over splinded mandrel 108 and is restrained from axial movement therealong by a downward facing shoulder 206 formed on mandrel 108 and the upper surface of lower mandrel 196. For a better view of the structure associated with indexing sleeve 204, attention is directed to FIG. 5.

An outer cylindrical surface 208 on indexing sleeve 204 includes a continuous slot, such being generally indicated at 210. Slot 210 includes a repeating zig-zag portion 212 which rotates sleeve 204 counter-clockwise, as viewed from above, upon reciprocation of mandrel 108 relative to cylindrical outer housing 32.

Slot 210 further includes first and second vertical slot portions 214, 216. Each of slot portions 214, 216 includes an upper and lower leg, like upper leg 218 and lower leg 220 in slot 214. Connecting slot portions 222, 224 connect repeating zig-zag portion 212 with vertical slot portions 214, 216. Zig-zag portion 212 includes a first leg 226 having an upper surface 228 and a lower surface 230. Each of the other legs in zig-zag portion 212 includes similar upper and lower surfaces. Likewise each of vertical slot portions 214, 216 includes upper and lower surfaces like upper surface 232 and lower surface 234 in slot portion 214.

A ball 236 is biased into slot portion 214 and more particularly into the lower portion of the slot as viewed in both FIGS. 5 and 2E.

In FIG. 2E, ball 236 is mounted on the radially inner surface of an annular shoulder 238 which is formed on the radially inner surface of lower housing section 48. For a more detailed description of ball 236, its associated structure, and the manner in which ball 236 interacts with indexing sleeve 204 see U.S. Pat. No. 4,355,685 to Beck which description is incorporated herein by reference.

An annular shoulder 240 is formed on the radially inner surface of lower housing section 48 about its circumference. Annular shoulder 240 includes a pair of opposed slots 242, 244 which are viewable in FIG. 4.

Annular shoulder 238 includes a pair of opposed slots 246, 248 with slot 246 being axially aligned with slot 242 and slot 248 being axially aligned with slot 244.

Indexing sleeve 204 includes a pair of opposed load lugs 250, 252, such being viewable in FIG. 4. In the view of FIG. 4, opposing lugs 250, 252 are received within slots 244, 242, respectively. Load lug 252 is viewable in FIG. 5 and is shown in dashed lines in FIG. 2E, such indicating where load lug 252 is positioned on the rear side of index sleeve 204, with lug 250 being half cut away in the quarter section and half obscured by lower housing section 48.

Load lug 252 includes an upper abutment surface 254 and a lower abutment surface 256. Abutment surfaces 254, 256 comprise the upper and lower surfaces, respectively, of the load lug which extends outwardly from surface 208 of indexing sleeve 204.

In FIG. 2E, annular shoulder 240 includes upper and lower abutment surfaces 258, 260, respectively.

Also in FIG. 2E, shoulder 238 includes upper and lower abutment surfaces 262, 264, respectively. The upper surface of lower mandrel 196 comprises an abutment surface 266 with surface 264 being abutted against surface 266 in the view of FIG. 2E.

Additional abutment surfaces are seen in FIGS. 2C and 2D and include surface 268 on the lower end of lower valve sleeve 70 and surface 270 on the upper end of retaining mechanism housing section 44. As will be explained hereinafter, the various abutment surfaces interact with one another to limit the axial movement of valve mandrel 54 and thereby place the valve in a closed condition, in a condition for circulation of fluids, or in a condition for reverse circulation of fluids.

Figure 2F:
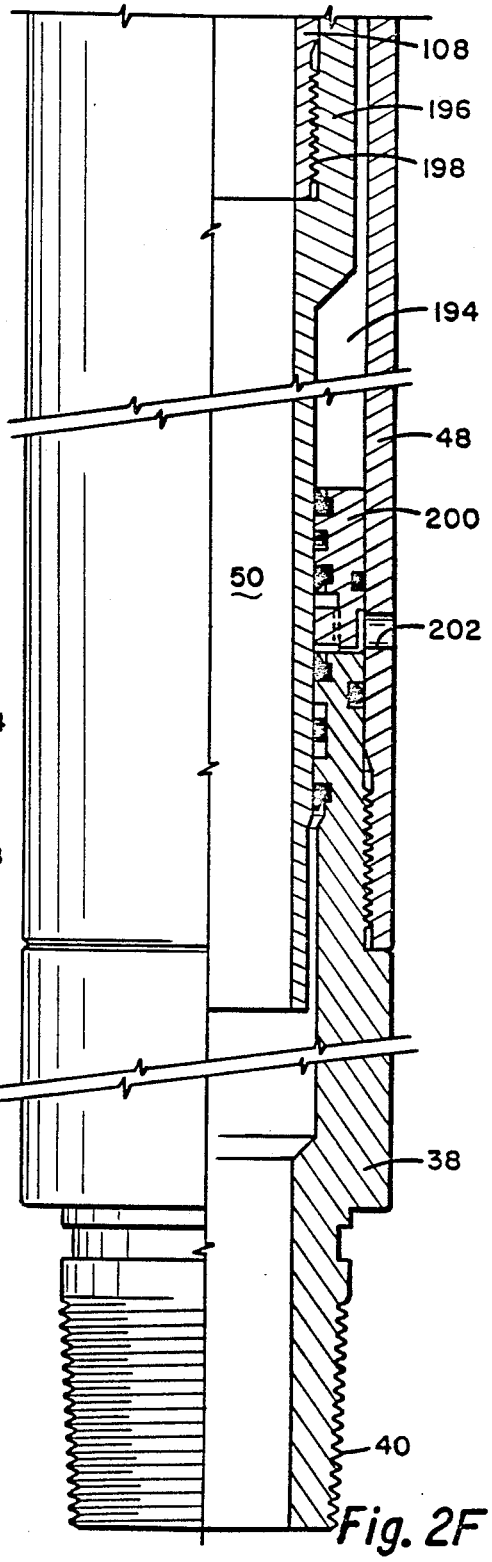

In assembling tool 30, lower housing adapter 38 is threadably engaged to lower housing section 48 via the threads shown in FIG. 2F. Thereafter mandrel 108, with indexing sleeve 204 received thereabout, is lowered into lower housing section 48. Next, intermediate housing section 46 is fitted over mandrel 108 with opposing lugs 193, 195, being aligned with and received in opposing slots 178, 180, respectively, on mandrel 108. Section 46 is lowered until the lower threads thereof engage the upper threads of lower housing section 48. Thereafter, section 46 is rotated, such rotation also rotating mandrel 108 since lugs 193, 195 are received in slots 178, 180. When sections 46, 48 are tightly threadably engaged, the lower end of spring 150 is fitted over the upper end of mandrel 108 and is slided toward its installed position as shown in FIGS. 2D and 6. Lugs 174, 176 are received in slots 178, 180, respectively. It can be seen that when the segments on the spring, like segment 158, abut against cam shoulder 134 on mandrel 108 further downward movement of the spring is prevented.

Spring retainer 138 is used as a tool to splay the spring fingers radially outwardly in order to maintain each of the spring segments in a radially outer position to enable sliding the spring to its installed position. Spring retainer 138 is fitted over mandrel 108 in a reverse position from that shown in FIGS. 6 and 2D. In other words, bevel 140 on spring retainer 138 is directed downwardly toward the upper tips of the spring fingers. Spring retainer 138 is urged against the upper portion of the spring causing each of the spring fingers, like fingers 152, 154, 156, to be biased outwardly when the radially inner surfaces of the upper portion of each spring finger rides onto beveled portion 140 of spring retainer 138. Spring retainer 138 is received within the upper portion of the spring a sufficient amount to splay the fingers outwardly to permit each of the spring segments, like segments 158, 160, 162, to clear cam shoulder 134 and each of the cam shoulders in grooves 116, 118, 120. Such enables the lower end of the spring to approach shoulder 190 in FIG. 2D.

It can be seen that lugs 174, 176 of the spring are received in slots 178, 180 as the spring is lowered to its installed position. With the spring lowered to the position of FIG. 2D, spring retainer 138 is withdrawn from the spring thereby enabling the fingers to return to an unbiased condition thus causing each of the segments, like segments 158, 160, 162 on the spring to be received within groove 120 as shown in FIG. 2D.

Thereafter, spring retainer 138 is removed from mandrel 108, turned over and lowered over the mandrel until it assumes the position in FIG. 2D. Next, retaining mechanism housing section 44 is lowered over the mandrel and is threadably engaged with threads at the lower end thereof to section 46 as shown in FIG. 2D.

Spring retainer 138 may rotate relative to both housing section 44 and the spring fingers on spring 150 as the housing section is threadably engaged with housing section 46. Lugs 193, 195 on intermediate housing section 46 are received in mandrel 108 and thus prevent mandrel rotation as retaining mechanism housing section 44 is threadably engaged with section 46. Likewise, lugs 174, 176 on spring 150 are received in slots 178, 180, respectively, on mandrel 108 thus preventing rotation of spring 150 as section 44 is threadably engaged with section 46. Rotation of spring retainer 138 as section 44 is threaded onto section 46 prevents binding of the fingers against housing section 44 as would be the case if a downward facing shoulder were formed on section 44 to restrain upward movement of spring 150. In other words, if spring retainer 138 should bind against housing section 44, the spring retainer may still rotate freely relative to the spring fingers If on the other hand the retainer should bind against the fingers, housing section 44 can rotate freely relative to the spring retainer.

The spring retainer thus serves as a tool to assist in assembling the retaining mechanism and thereafter, when installed, serves to prevent damage to the spring fingers when housing section 44 is added.

A person having ordinary skill in the art will readily understand how the remaining components of the tool are assembled to place the tool in the condition shown in FIGS. 2A–2F.

In operation, prior to suspending tool 30 on a pipe string in a well bore, mandrel 108 is axially reciprocated relative to housing 32 in order to place ball 236 in the lower end of leg 226 as shown in dashed lines in FIG. 5. In this position ball 236 is adjacent lower surface 230. When ball 236 is in the lower portion of leg 226 adjacent surface 230, abutment surface 254 of load lug 252 and the upper surface of the opposing load lug are abutted against abutment surface 260 on the underside of annular shoulder 240. When surfaces 254, 260 are so abutted, ball 236 is not abutted against surface 230 on the lower portion of leg 226 but rather is position just adjacent thereto.

When splined mandrel 108 is positioned with ball 236 in leg 226 as described above, valve mandrel 54 is positioned over circulation port 90 in FIG. 2C between O-rings 58, 60. Thus, fluid communication between passageway 50 and the exterior of tool 30 is prevented. Also the substantially annular collar formed by the segments, like segments 158, 160, 162, on the radially inner surface of spring 150 is received in groove 118 when splined mandrel 108 is so positioned. As will later be described, the spring segments may be similarly received in each of the grooves formed on mandrel 108, and against cam shoulder 134 on mandrel 108, as mandrel 108 axially shifts within cylindrical housing 32.

With the tool configured as described above, it is assembled into the pipe string and lowered into the well bore as shown in FIG. 1. With this arrangement fluids may be pumped into the pipe string on which tool 30 is suspended for purposes of fracturing or injecting acid into the formation. Also, the annulus between tool 30 and the well bore may be pressurized in order to operate different tools in the drill string testing arrangement.

With ball 236 in the lower portion of leg 226, when fluid is pumped down the pipe string upon which the tool is suspended, passageway 50 is pressurized thus urging splined mandrel 108 downwardly. Mandrel 108 is urged downwardly under such pressurization due to the action of an annular piston which is defined by an outer diameter at O-ring pair 76 in FIG. 2C and by an inner diameter at O-ring 137 in FIG. 2D. Fluid pressure in passageway 50 acts across the difference in area between O-ring pair 76 and O-ring 137 to urge splined mandrel 108 downwardly.

It can be seen, in FIG. 2D, that such downward force on mandrel 108 causes cam shoulder 124 to abut against cam shoulder 164, which is now received in groove 118 in the same fashion that segment 158 is shown in groove 120, on segment 158 of spring 150. In a similar fashion each of the other upper cam shoulders on each of the spring segments have cam shoulder 124 abutting thereagainst. When the pressure in passageway 50, which is applied to the upper side of the annular piston is greater than the pressure in the annulus, which is applied to the lower surface of the annular piston via port 114, by a predetermined value, each of the spring fingers, like fingers 152, 154, 156, in spring 150 bow outwardly in response to the camming action of cam shoulder 124 on mandrel 108 against each of the segment upper cam shoulders, like cam shoulder 164. In the instant embodiment of the invention, the required pressure differential is approximately 300 p.s.i. When cam shoulder 124 rides downwardly against cam shoulder 164, it can be seen that the spring bows outwardly into annular space 188 and the radially inner surface of each of the segments, like segments 158, 160, 162 is received substantially flushly against the radially outer surface of mandrel 108 above groove 118.

When the segments are so received against mandrel 108, the mandrel is freely slidable thereagainst and continues downward travel until ball 236 is received in the upper portion of leg 226, as shown in dashed lines in FIG. 5, adjacent surface 228. When ball 236 is so received, segment 158, as well as each of the other segments, is received in groove 116 and the fingers of spring 150 are no longer braced outwardly.

It is to be appreciated that downward movement of mandrel 108 is stopped when lower surface 256 on load lug 252 and the lower abutment surface on the opposing load lug strike upper abutment surface 262 on shoulder 238. Such occurs when ball 236 is in the position shown in dashed lines adjacent upper surface 228. Such abutment prevents ball 236 from abutting against surface 228 with a significant amount of force.

Just as the downward movement of mandrel 108 is stopped by impact of the abutment surfaces as described above, segment 158, and each of the other segments, is received in groove 116. When the tool is so configured, if the pressure in the annulus should increase, or the pressure in passageway 50 decrease, so that the pressure on the underside of the annular piston is greater than that on the upper side, lower cam shoulder 128 in groove 116 will be urged against lower cam shoulder 166 of segment 158 as well as each of the other segment lower cam shoulders. Mandrel 108 is thus restrained from upward movement until upward pressure sufficient to bow spring 150 outwardly thereby forcing the segments onto the radially outer surface of mandrel 108 beneath groove 116 is applied to the underside of the piston. As previously mentioned, the instant embodiment of the invention requires a positive pressure in the annulus relative to passageway 50 of 300 p.s.i. to release mandrel 108. Thus, pressure surges from the pump at the surface of pressure generated when the pipe string is pulled from the well bore will be insufficient to inadvertantly move mandrel 108 from the position in which it is retained by spring 150.

On the other hand, once a pressure differential sufficient to bow spring 150 outwardly is applied, the radially inner surface of each of the segments, like segment 158, in the spring flushly abut against the radially outer surface of mandrel 108 and permit axial mandrel movement relative to the spring responsive to pressure differentials of far less than 300 p.s.i.

After ball 236 is positioned in the upper portion of leg 226, it may be necessary or desirable to operate a tool in the drill string testing arrangement by applying pressure to the annulus between the drill string and the well bore. Such pressure, in addition to the hydrostatic pressure in the annulus, is communicated to annular space 112 via port 114 in FIG. 2D and serves to urge mandrel 108 upwardly relative to housing 32. When such pressure exceeds, in the instant embodiment of the invention, 300 p.s.i., spring 150 bows outwardly and mandrel 108 moves upwardly until ball 236 is received in the lower portion of the leg adjacent leg 226. Further upward piston mandrel movement is stopped by the action of abutment surface 254 against abutment surface 260 on the underside of annular shoulder 240. When such abutment occurs, the segments of spring 150 are again received within groove 118 of mandrel 108 and restrain the mandrel from upward axial movement until the upward pressure against the annular piston exceeds 300 p.s.i.

When ball 236 is received within zig-zag portion 212, although mandrel 108 (and thus valve mandrel 54) are reciprocated between the upper and lower portions of slot 212, circulation port 90 is always between O-rings 58, 60 thus sealing the port from fluid communication between the interior and exterior of the tool.

It can be seen that by alternately pumping down the drill string and the annulus or pumping down and releasing pressure in the drill string, ball 236 is successively moved along zig-zag portion 212 until it is received in the upper portion of the leg to the immediate right of slot portion 222. Each time ball 236 is received in an uppermost leg of zig-zag portion 212, as shown in dashed lines adjacent upper surface 228, the spring segments, like segment 158, are received in groove 116. Each time ball 236 is received in a lowermost leg of zig-zag portion 212, as shown in dashed lines adjacent lower surface 230, segment 158 and each of the other segments in spring 150 are received in groove 118. As previously described, a pressure differential of approximately 300 p.s.i. between passageway 50 and the annulus is necessary before mandrel 108 may be moved between the position in which segment 158 and each of the other segments in spring 150 are received in groove 116 and the position in which the segments are received in groove 118.

When pressure in the pipe string is released, the normal hydrostatic pressure in the annulus will act on mandrel 108 through port 114 and urge it upwardly relative to cylindrical housing 32. Thus, the annulus does not have to be pressurized to axially reciprocate mandrel 108 and move zig-zag portion 212 relative to ball 236.

When ball 236 is received in the upper portion of the leg to the immediate right of slot portion 222, annulus pressure may be applied, or drill string pressure released, until the annulus pressure is greater (by 300 p.s.i.) than the pressure in passageway 50 to urge mandrel 108 upwardly thereby causing ball 236 to enter slot portion 222 and thereafter lower leg 220 as the mandrel continues its upward movement. Abutment surface 254 does not strike abutment surface 260 on the lower surface of shoulder 240 as during piston mandrel reciprocation when ball 236 is received in zig-zag portion 212. This is because load lugs 250, 252 are received within slots 242, 244 as shown in FIG. 4 and thus permit movement of ball 236 down lower leg 220.

Just prior to abutment of ball 236 against lower surface 234, abutment surface 264 on the lower side of shoulder 238 abuts against surface 266 on the upper side of lower mandrel 196 thus stopping further mandrel movement and preventing ball 236 from absorbing a significant axial load. As such occurs, segment 158 and each of the other spring segments are received in groove 120 as shown in FIG. 2D. The tool is thus in the configuration shown in FIGS. 2A–2F.

As mandrel 108 moves from the position in which ball 236 is received in the upper portion of the leg to the immediate right of slot portion 222 until the ball is received in the lowermost portion of lower leg 220 as shown in FIG. 5, the spring segments change from a position in which they are received in groove 116 to a position in which they are received in groove 120 as shown in FIG. 2D. In order to so move, the segments momentarily pass through groove 118. Although it is necessary to achieve the 300 p.s.i. pressure differential as previously described in order for mandrel 108 to begin upward movement, after such movement is achieved the pressure need not be maintained, even as the segments pass through groove 118, because of the momentum of the mandrel. It is important that mandrel momentum be maintained as the mandrel moves to its uppermost position as shown in the drawings. It can be seen that as mandrel 108 moves upwardly, seals 60, 62 move above port 90. As soon as seal 62 is above the lowermost portion of the port, reverse circulation through port 90 begins. After such occurs, greatly increasing the pressure in the annulus serves only to increase reverse flow rather than to pressurize annular space 112 via port 114. Thus, it is necessary that a sufficient upward momentum of mandrel 108 is achieved to maintain mandrel movement until it assumes its uppermost position as shown in the drawings. Since the radially inner surface of each of the spring segments exert very little drag against the radially outer surface of the mandrel as it moves thereby, mandrel momentum is not impeded, and, once a sufficient upward force is generated to initiate mandrel movement from the position in which the spring segments are received in collar 116 the mandrel will easily move to its uppermost position as shown in the drawings.

When the tool is configured as shown in FIGS. 2A–2F, valve mandrel 54 is positioned relative to port 90 as shown in FIG. 2C. When so positioned, fluid may be reverse circulated through port 90, (and the other circulation ports), bore 88 (and the other bores about the perimeter of valve mandrel 54 adjacent bore 88), into annular space 86 on the radially inner surface of valve mandrel 54 and into passageway 50 via a channel defined between the radially inner surface of valve mandrel 54 and surface 82 of valve portion 80.

Thus when valve mandrel 54 is in configuration of FIG. 2C, the well may be reverse circulated but, because of the action of resilient valve portion 80, the well may not be circulated from the drill string into the annulus. When pressure in passageway 50 is greater than the pressure in the well annulus, surface 82 sealingly engages the radially inner surface of the valve mandrel thus preventing flow between passageway 50 and the annulus.

Since such flow may not occur, when it is desired to place the tool in condition for circulation, passageway 50 may be pressurized (by pumping down the drill string). With the collar segments received in groove 120, the pressure in passageway 50 must exceed the annulus pressure by approximately 300 p.s.i. before downward movement of mandrel 108 may be effected. When such pressure occurs, spring 150 is bowed radially outwardly by the action of cam shoulder 126 against cam shoulder 164 in FIG. 2D. Thereafter, the radially inner surface of each of the segments in spring 150 rides against the radially outer surface of mandrel 108 between grooves 120, 118 until the segments are received in groove 118. During such travel of mandrel 108, very little drag is exerted by the action of the radially inner surface of the segments of spring 150 against the radially outer surface of the mandrel.

As mandrel 108 is urged downwardly, ball 236 moves upwardly in leg 220 and into leg 218 until the ball is adjacent surface 232. Just prior to impact of surface 232 and ball 236, surface 268 on the lower end of lower valve sleeve 70 abuts against surface 270 on the upper end of retaining mechanism housing section 44 thus stopping further downward movement of mandrel 108 and preventing ball 236 from bearing significant forces as a result of impact with surface 232.

As the mandrel travels from its uppermost position, shown in the drawings, to its lowermost position, the segments on spring 150 are momentarily received in groove 118 and then groove 116. While it is necessary to achieve a pressure in passageway 50 which is approximately 300 p.s.i. greater than that in the well annulus in order to urge the spring segments outwardly from groove 120 to initiate mandrel movement, the 300 p.s.i. differential need not be maintained in order to move the spring segments in and out of grooves 118, 116 because the momentum of mandrel 108 generates force which tends to urge the segments out of the grooves by action of the groove cam shoulders against the cam shoulders on the segments. After groove 116 in mandrel 108 passes beneath the segments of spring 150, the radial inner surface of each of the spring segments is urged against the radially outer surface of mandrel 108 between groove 116 and cam shoulder 134. Just as ball 236 is received adjacent surface 232 in upper leg 218, cam shoulder 166 on segment 158 and each of the other segment lower cam shoulders are received against cam shoulder 134. Mandrel 108 is thus restrained from further upward movement due to the abutment of surfaces 268, 270 and is restrained from downward movement until the pressure in passageway 50 exceeds the pressure in the annulus by approximately 300 p.s.i. because of the action of the lower cam shoulders of each segment action of the lower cam shoulders of each segment against cam shoulder 134 and mandrel 108. It is important that mandrel momentum be maintained during downward travel of mandrel 108 after groove 116 passes beneath the spring segments. As soon as O-ring 56 (in FIG. 2B) passes beneath circulating port 90, circulation between passageway 50 through port 90 into the annulus begins. Increasing pipe string pressure serves only to increase such flow rather than to urge mandrel 108 downwardly. As in the previously described case of mandrel movement to the reverse circulation position, spring 150 does not act to exert substantial drag against mandrel 108 after movement thereof is underway. Such permits mandrel movement into the fully opened positive circulation position with segment shoulder 166 abutted against mandrel shoulder 134.

When mandrel 108 is in its lowermost condition, O-ring 56 of valve mandrel 54 is beneath circulating port 90 thus permitting circulation from pasageway 50 into the well bore as follows. When pressure in passageway 50 increases above that in the annulus, fluid flows through bores 104 into annular space 102, between surface 98 and the radially outer surface of valve mandrel 54, and through port 90 into the annulus.

When so configured, if annulus pressure exceeds that of passageway 50, flow does not occur through port 90 because surface 98 sealingly engages the radially outer surface of valve mandrel 54.

If it is desired to return the tool to its closed position in which neither circulation nor reverse circulation can occur, the annulus is pressurized (or pipe string pressure is reduced) until the annulus pressure is at least approximately 300 p.s.i. greater than pipe string pressure. When such occurs, the lower cam shoulders of each of the spring segments, like lower shoulder 166 on segment 158, ride down cam shoulder 134 on mandrel 108 thus driving mandrel 108 upwardly and causing ball 236 to move down leg 218 and into the zig-zag portion (not shown) on surface 208 opposite zig-zag portion 212.

The tool is again in condition to permit repeated alternate applications of annulus and drill string pressure or application and release of drill string pressure without shifting the tool into condition for circulation or for reverse circulation. Such alternating pressure changes must produce pressure differentials between the central fluid passage of the tool and the annulus of at least 300 p.s.i. thereby preventing pump surges and pressure differentials created during raising and lowering of the pipe string from inadvertantly cycling mandrel 108 to a different position. It can be seen that, in the tool of the preferred embodiment, five such alternate applications and releases of pipe string pressure must occur before the tool is again placed in condition for reverse circulation. Thereafter application of drill string pressure places the tool in condition for circulation to permit, for example, the spotting of fluids into the well bore adjacent the tool. It will be apparent to one skilled in the art that more or fewer than five cycles may readily be employed by changing the configuration of the slot in which ball 236 is received.

It can be seen that the tool permits alternate pumping of fluids into the formation and operation of various tools by pressurizing the well without placing the tool in condition for circulation or reverse circulation until the annulus and drill string have been alternately pressurized a predetermined number of times. Such alternate pressurizations, as previously noted, must have pressure differentials of at least, in the instant embodiment of the invention, 300 p.s.i. It will be apparent to one skilled in the art that the tool may be designed so that pressure differentials of less than or more than 300 p.s.i. are necessary in order to cycle the tool to a different position.

The tool of the invention permits reversing fluids out of the drill string and thereafter spotting fluids, for example nitrogen, into the well bore adjacent the tool. Thereafter, annulus pressure can be increased to actuate other valves and/or tools in the well bore without compressing the nitrogen in the drill string and without inadvertantly cycling the tool to a different position.

Thus, the tool permits selectively reverse circulating and spotting fluids down the well while at the same time permitting application of drill string and annulus pressure to pump fluids and actuate other tools and permits raising and lowering of the pipe string without unintentionally shifting the position of the mandrel in the tool. Such unintentional shifting of the mandrel may ultimately lead to inadvertantly opening or closing the circulation valve.

It is thus seen that the downhole tool of the present invention readily achieves the ends and advantages mentioned as well as those inherent therein. Although a presently preferred embodiment of the invention has been specifically described for the purposes of this disclosure, numerous changes in the arrangement and construction of parts can be made by those skilled in the art which changes are encompassed within the spirit and scope of this invention as defined by the appended claims.

I claim:

1. A downhole tool adapted to be suspended in a well bore on a pipe string comprising:

a cylindrical housing having an open longitudinal passageway therethrough;

a mandrel slidably received in said housing and being axially moveable between a first position and a second position;

means for reversibly moving said mandrel between said first and second positions responsive to a pressure differential between the interior of said pipe string and the annulus of said well bore; and mandrel retaining for retaining said mandrel in one of said positions until such a pressure differential exceeds a predetermined value, said retaining means being constructed and arranged to so retain said mandrel each time said mandrel moves to said one position.

2. The downhole tool of claim 1 wherein said retaining means is constructed and arranged to permit movement of said mandrel, when said mandrel is not so retained, responsive to such a pressure differential which is substantially less than said predetermined value.

3. The downhole tool of claim 1 wherein said retaining means further includes means for retaining said mandrel in the other of said positions until such a pressure differential exceeds a predetermined value, said means for retaining said mandrel in the other of said positions being constructed and arranged to so retain said mandrel in said other position each time said mandrel moves to said other position.

4. The downhole tool of claim 1 wherein said retaining means comprising a spring member disposed between said housing and said mandrel.

5. A downhole tool adapted to be suspended in a well bore on a pipe string comprising:

a cylindrical housing having an open longitudinal passageway therethrough;

a mandrel slidably received in said housing and being axially moveable between a first and second position, said mandrel includes a recess formed on the radially outer surface thereof;

means for moving said mandrel between each first and second positions responsive to a pressure differential between the interior of said pipe string and the annulus of said well bore; and mandrel retaining means for retaining said mandrel in one of said positions until such pressure differential exceeds a predetermined value, said mandrel retaining means being constructed and arranged to so retain said mandrel each time said mandrel moves to said position, said mandrel retaining means including a spring member, disposed between said housing and said mandrel, for engaging said recess formed on the radially outer surface of said mandrel, wherein said mandrel retaining means is constructed and arranged to permit movement of said mandrel, when said mandrel is not so retained, responsive to such a pressure differential which is substantially less than said predetermined value, and wherein said mandrel retaining means includes means for retaining said mandrel in the other of said positions until such a pressure differential exceeds a predetermined value, said means for retaining said mandrel in the other of said positions being constructed and arranged to so retain said mandrel in said other position each time said mandrel moves to said other position.

6. The downhole tool of claim 5 wherein said spring member comprises an elongate finger having a cam surface disposed toward said mandrel and wherein said mandrel recess defines a cam surface adapted to engage said finger cam surface, said mandrel being retained in said one position when said cam surface are so engaged.

7. A circulation valve adapted to be suspended in a well bore on a pipe string comprising:

a cylindrical housing having an open longitudinal passageway therethrough and a circulation port disposed through a wall thereof;

a valve mandrel slidably received in said housing and reversibly axially movable between a first position closing said circulation port and a second position in which fluid may be circulated through said port;

annular piston means received in said housing and being operatively connected to said valve mandrel, said piston means having a first side subject to pressure in the annulus of said well bore and a second side subject to pressure in said pipe string, said piston means moving said valve mandrel toward one of said positions when the pressure on said first side exceeds the pressure on said second side and moving said mandrel toward the other of said positions when the pressure on said second side exceeds the pressure on said first side;

mandrel retaining means for retaining said valve mandrel in one of said positions each time said valve mandrel is in said one position; and means for releasing said valve mandrel from said one position responsive to an increase in such a pressure differential above a predetermined value.

8. The circulation valve of claim 7 wherein said retaining means compresses an annular spring member mounted on the radially inner surface of said housing, said spring member being biased toward said mandrel for engaging the same at a predetermined position along said mandrel.

9. A circulation valve adapted to be suspended in a well bore on a pipe string comprising:

a cylindrical housing having an open longitudinal passageway therethrough and a circulation port disposed through a wall thereof;

a valve mandrel slidably received in said housing and axially movable between a first position closing said circulation port and a second position in which fluid may be circulated through said port, said mandrel includes a circumferential groove formed on the radially outer surface thereof;

annular piston means received in said housing and being operatively connected to said valve mandrel, said piston means having a first side subject to pressure in the annulus of said well bore and a second side subject to pressure in said pipe string, said piston means moving said valve mandrel toward one of said positions when the pressure on said first side exceeds the pressure on said second side and moving said mandrel toward the other of said positions when the pressure on said second side exceeds the pressure on said first side;

mandrel retaining means for retaining said valve mandrel in one of said positions each time said valve mandrel is in said one position, said mandrel retaining means includes an annular spring member mounted on the radially inner surface of said housing, said spring member being biased toward said mandrel for engaging said circumferential groove each time said grove passes by said spring member; and means for releasing said valve mandrel from said one position responsive to an increase in such a pressure differential above a predetermined value.

10. The circulation valve of claim 9 wherein said spring member comprises a plurality of elongate fingers disposed about the circumference of said mandrel, said spring member having a substantially annular collar formed on the radially inner surface thereof for engaging said mandrel groove.

11. The circulation valve of claim 10 wherein said spring member is restrained against vertical movement relative to said housing by upper and lower shoulders formed on the radially inner surface of said housing.

12. The circulation valve of claim 11 wherein one of said housing shoulders is formed on the radially inner surface of a freely rotatable annular ring.

13. In a downhole tool having a cylindrical housing section in which a mandrel section is reversibly axially movable responsive to a pressure differential across said housing, the improvement comprising:

mandrel retaining means for retaining said mandrel section each time said mandrel section assumes a predetermined axial position relative to said housing; and means for releasing said mandrel section from its retained position responsive to an increase in such a pressure differential above a predetermined value.

14. In a downhole tool having cylindrical housing section in which a mandrel section is axially movable responsive to a pressure differential across said housing, the improvement comprising:

mandrel retaining means for retaining said mandrel section each time said mandrel section assumes a predetermined axial position relative to said housing, said mandrel retaining means includes an elongated finger disposed between the inner surface of said housing section and the outer surface of said mandrel section, said finger being fixed relative to one of said sections and having a ridge formed thereon which is directed toward said other section, said ridge engaging a recess formed in said other section to so retain mandrel section movement; and means for releasing said mandrel section from its retained position responsive to an increase in such a pressure differential above a predetermined value.

15. The downhole tool of claim 14 wherein said elongate finger is fixed relative to said housing section and wherein said recess comprises a groove formed about the circumference of said mandrel section.

16. The downhole tool of claim 15 wherein said ridge comprises a substantially arcuate segment formed on the radially inner surface of said elongate finger, said arcuate segment defining a cam shoulder on the upper or lower surface thereof.

17. The downhole tool of claim 16 wherein said circumferential groove includes a cam shoulder formed to permit said segment cam shoulder to abut thereagainst in a substantially flush manner when said segment is received in said groove.

18. The downhole tool of claim 17 wherein said elongate finger is constructed to bow radially outwardly to permit said mandrel to axially move until said groove no longer has said segment received therein responsive to an increase of such a pressure differential above said predetermined value.

19. The downhole tool of claim 18 wherein said tool further includes such shoulders formed on both the upper and lower portions of said segment and said groove to restrain axial mandrel movement in either direction and to permit such movement in either direction responsive to an increase of such a pressure differential above said predetermined value.

20. The downhole tool of claim 19 wherein the improvement further comprises a plurality of such grooves formed about the circumference of said mandrel section.

* * * * *

UNITED STATES PATENT AND TRADEMARK OFFICE

CERTIFICATE OF CORRECTION

PATENT NO. : 4,817,723

DATED : April 4, 1989

INVENTOR(S) : Paul D. Ringgenberg

It is certified that error appears in the above-identified patent and that said Letters Patent is hereby corrected as shown below:

In column 5, line 1, the word "o" should read --to--, as set forth on page 10, line 12 of the specification.

In column 6, line 17, after "100." insert therefore --A space 102 is formed--, as set forth on page 13, line 9 of the specification.

In column 6, line 44, the word "32" should read --132--, as set forth on page 14, line 6 of the specification.

In column 6, line 47, the word "37" should read --137--, as set forth on page 14, line 9 of the specification.

In column 10, line 20, after the word "fingers" insert therefore --.--, as set forth on page 22, line 20 of the specification.

In column 14, line 44, the word "radial" should read --radially--, as set forth on page 32, line 24 of the specification.

In column 14, line 57 should be deleted, therefore delete "action of the lower cam shoulders of each segment", as this wording is printed twice.

In column 16, line 32, after the first mentioned word "retaining" insert therefore --means--, as set forth in claim 1, line 11 and page 2 of the amendment dated July 8, 1988.

In column 16, line 62, the word "each" should read --said--, as set forth on page 2, of the amendment dated July 8, 1988.

UNITED STATES PATENT AND TRADEMARK OFFICE

CERTIFICATE OF CORRECTION

PATENT NO. : 4,817,723

DATED : April 4, 1989

INVENTOR(S) : Paul D. Ringgenberg

It is certified that error appears in the above-identified patent and that said Letters Patent is hereby corrected as shown below:

In column 17, line 3, after the first mentioned word "said" insert therefore --one--, as set forth on page 3 of amendment dated July 8, 1988.

In column 17, line 55, the word "compresses" should read --comprises--, as set forth on page 39, line 2 of claim 8, of the specification.

In column 18, line 51, after the word "having" insert therefore --a--, as set forth on page 5 of the amendment dated July 8, 1988.

Signed and Sealed this

Seventh Day of November, 1989

*Attest:*

JEFFREY M. SAMUELS

*Attesting Officer*

*Acting Commissioner of Patents and Trademarks*